US005921850A

United States Patent [19]

Brooks et al.

[11] Patent Number: 5,921,850

[45] Date of Patent: Jul. 13, 1999

[54] APPARATUS FOR LOADING A WORKPIECE INTO A THROUGH-FEED MECHANISM

[75] Inventors: James E. Brooks, Morresburg; Tony M. Murray, Bristol, both of Tenn.

[73] Assignee: TRW Inc., Lyndhurst, Ohio

[21] Appl. No.: 08/885,589

[22] Filed: Jul. 1, 1997

Related U.S. Application Data

[51] Int. Cl.[6] ..... B24B 5/00; B24B 5/18

[52] U.S. Cl. ..... 451/245; 451/331; 451/336; 451/339

[58] Field of Search ..... 451/245, 243, 451/242, 244, 332, 331, 333, 334, 336, 337, 339, 49, 28, 51, 335, 338; 198/624, 626.1, 626.4, 611, 638

[56] References Cited

U.S. PATENT DOCUMENTS

| | | | |
|---|---|---|---|
| 1,815,263 | 7/1931 | Larsen . | |
| 2,608,037 | 8/1952 | Lindhe . | |
| 2,655,066 | 10/1953 | Siegerist . | |
| 3,553,907 | 1/1971 | Price | 451/331 |
| 3,608,972 | 9/1971 | Rudszinat | 198/624 |
| 4,018,011 | 4/1997 | Whittenberg . | |
| 4,048,765 | 9/1977 | Samuelson . | |
| 4,051,634 | 10/1977 | Fisher . | |
| 4,167,081 | 9/1979 | Marmo . | |
| 4,209,087 | 6/1980 | Kushigian | 451/339 |
| 4,434,583 | 3/1984 | Burgess, Jr. . | |
| 4,594,815 | 6/1986 | Mickelson et al. | 451/336 |
| 4,640,056 | 2/1987 | Stump | 451/336 |
| 4,930,260 | 6/1990 | Itoh et al. . | |
| 5,042,203 | 8/1991 | Kobayashi | 451/331 |
| 5,558,202 | 9/1996 | Miller et al. | 198/624 |
| 5,620,082 | 4/1997 | Saito | 198/624 |

*Primary Examiner*—David A. Scherbel
*Assistant Examiner*—Derris H. Banks
*Attorney, Agent, or Firm*—Tarolli, Sundheim, Covell, Tummino & Szabo

[57] ABSTRACT

A loading apparatus (14) loads a workpiece (16) into a through-feed mechanism (20, 22, 24) which advances the workpiece (16) through a processing device (12) at an advancement speed. The loading apparatus (14) includes a roller assembly (30, 32) which grips the workpiece (16), and further includes a motorized drive train (34) which drives the roller assembly (30, 32) to urge the workpiece (16) toward the through-feed mechanism (20, 22, 24) at a speed greater than the advancement speed. The drive train (34) includes a slip clutch (86) which permits slippage in the drive train (34) under resistance transmitted through the workpiece (16) from the through-feed mechanism (20, 22, 24) to the roller assembly (30, 32). The roller assembly (30, 32) loads the workpiece (16) against the resistance of the through-feed mechanism (20, 22, 24) at a speed not greater than the advancement speed.

11 Claims, 2 Drawing Sheets

APPARATUS FOR LOADING A WORKPIECE INTO A THROUGH-FEED MECHANISM

FIELD OF THE INVENTION

The present invention relates to a workpiece processing device, such as a centerless grinder, and particularly relates to an apparatus for loading a workpiece into a through-feed mechanism in the processing device.

BACKGROUND OF THE INVENTION

A centerless grinder is a known device for grinding the cylindrical surfaces of metal workpieces such as bars or tubes. The grinder includes a grinding wheel and an adjacent regulating wheel. A workpiece support blade extends longitudinally between the grinding wheel and the regulating wheel. The support blade has an upper edge for supporting a workpiece along its length.

When the wheels in the grinder rotate, the grinding wheel grinds the cylindrical surface of a workpiece supported on the upper edge of the support blade. The regulating wheel simultaneously moves the workpiece longitudinally past the grinding wheel along the upper edge of the support blade. In this manner, the grinding wheel, the regulating wheel and the support blade function as a through-feed mechanism which advances the workpiece through the grinder while it is being ground.

The grinder initially resists movement of the workpiece longitudinally into the grinder between the grinding wheel and the regulating wheel. Therefore, the workpiece must be loaded into the grinder against the initial resistance. This is accomplished by moving the workpiece toward and into engagement with the grinder at a speed that is slightly greater than the advancement speed through the grinder, and with a force sufficient to overcome the initial resistance. However, grinding problems can occur if the workpiece is loaded into the grinder with an excessive speed and/or loading force.

SUMMARY OF THE INVENTION

The present invention comprises an apparatus for loading a workpiece into a through-feed mechanism. The through-feed mechanism advances the workpiece through a processing device, such as a centerless grinder, at an advancement speed.

In accordance with the present invention, the loading apparatus comprises a roller assembly which grips the workpiece. The loading apparatus further comprises a motorized drive train which drives the roller assembly to urge the workpiece toward the through-feed mechanism at a speed greater than the advancement speed. The drive train includes a slip clutch which permits slippage in the drive train under resistance transmitted through the workpiece from the through-feed mechanism to the roller assembly. The roller assembly thus loads the workpiece against the resistance of the through-feed mechanism at a speed not greater than the advancement speed.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
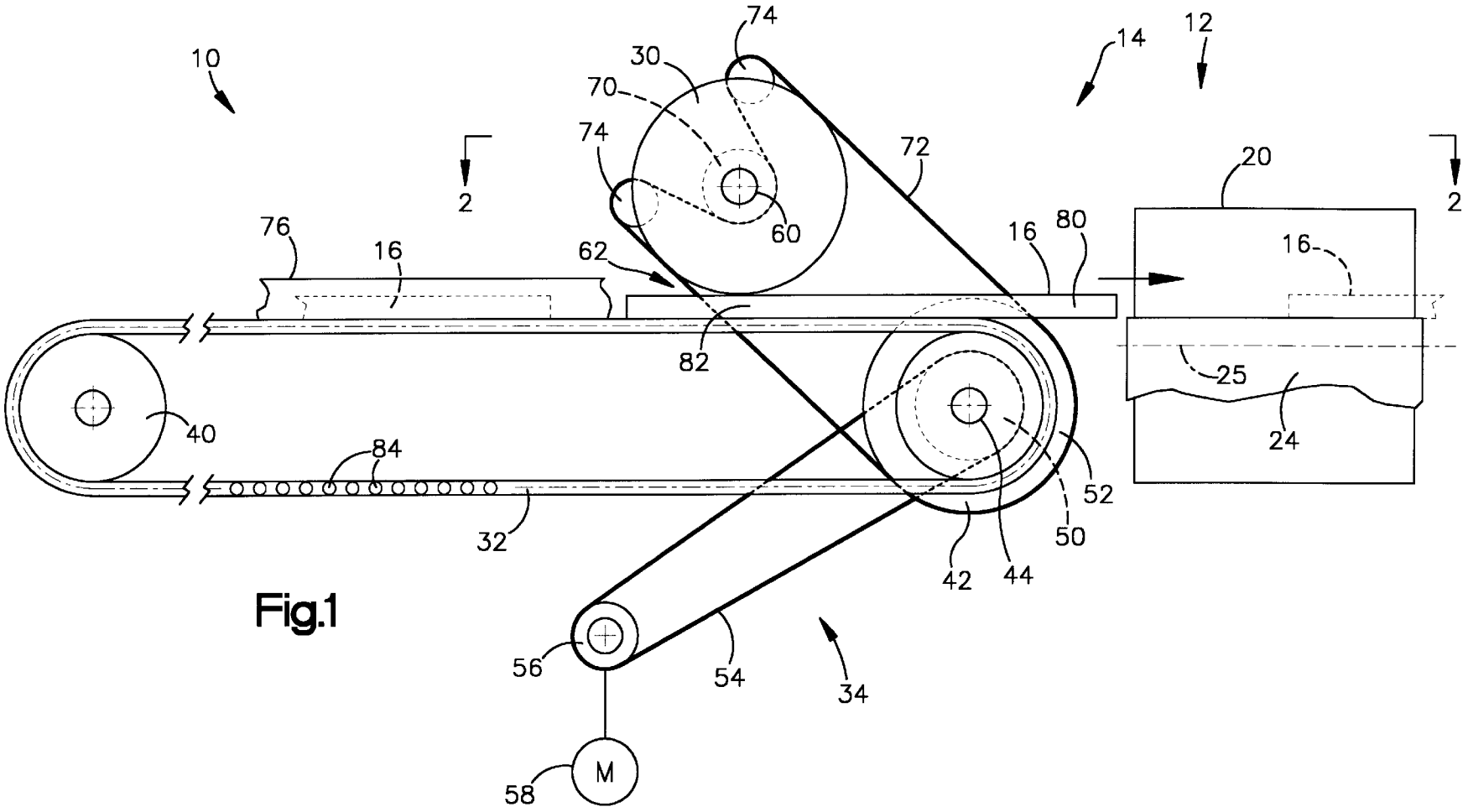
FIG. 1 is a schematic side view of an apparatus comprising a preferred embodiment of the present invention.
Figure 2:
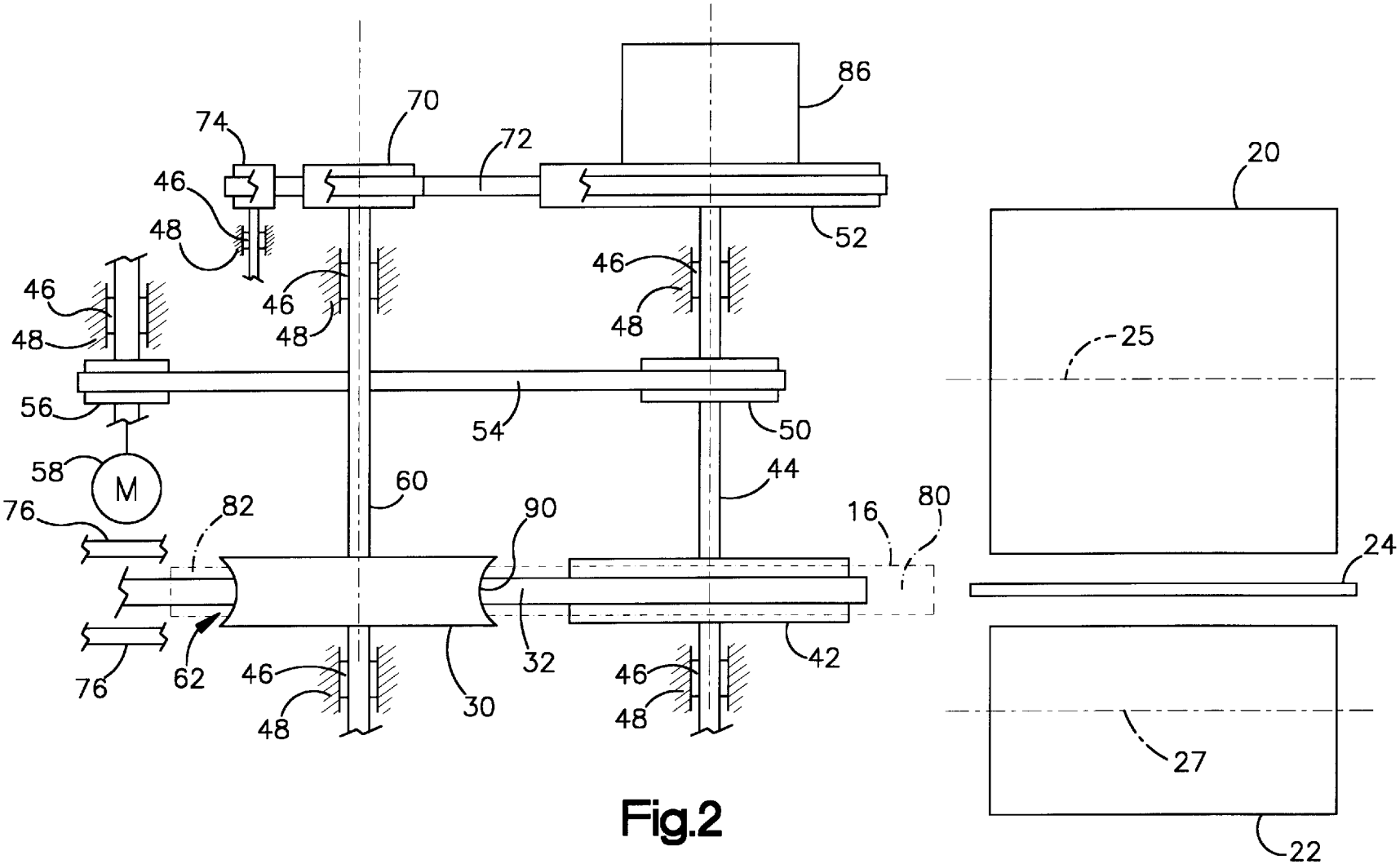
FIG. 2 is a top view taken on line 2—2 of FIG. 1.

An apparatus 10 comprising a preferred embodiment of the present invention is shown schematically in FIGS. 1 and 2. The apparatus 10 includes a processing device 12 and an apparatus 14 for loading workpieces 16 into the processing device 12. The processing device 12 in the preferred embodiment of the present invention is a centerless grinder. The workpieces 16 in the preferred embodiment are elongated steel bars of equal length. Such bars 16 may comprise, for example, steering racks for use in a rack and pinion steering gear. The loading apparatus 14 loads the bars 16 longitudinally into the grinder 12.

The grinder 12 is a known device including a grinding wheel 20 and an adjacent regulating wheel 22 (FIG. 2). A workpiece support blade 24 extends longitudinally between the grinding wheel 20 and the regulating wheel 22. A motorized drive train (not shown) in the grinder 12 rotates the grinding wheel 20 and the regulating wheel 22 about respective axes 25 and 27 in a known manner.

The axis 27 of the regulating wheel 22 is skewed slightly relative to the axis 25 of the grinding wheel 20. This causes the regulating wheel 22 to move a bar 16 along the support blade 24 while the grinding wheel 20 moves against the surface of the bar 16 between the rotating wheels 20 and 22. Accordingly, in addition to processing the bars 16 by grinding, the support blade 24 and the rotating wheels 20 and 22 function as a through-feed mechanism which advances the bars 16 through the grinder 12. The bars 16 are advanced through the grinder 12 at an advancement speed that varies with the rotational speed(s) of the wheels 20 and 22.

The loading apparatus 14 includes a pinch roller 30, a roller chain 32, and a motorized drive train 34. As described fully below, the pinch roller 30 and the roller chain 32 are driven by the drive train 34 so as to engage and move each bar 16 longitudinally into the grinder 12 at a controlled entry speed which is not greater than the advancement speed through the grinder 12.

The drive train 34 includes first and second sprockets 40 and 42 which move the roller chain 32 in a clockwise direction, as viewed in FIG. 1. The second sprocket 42 is supported on a rotatable drive shaft 44. As shown in FIG. 2, a plurality of bearings 46 support the drive shaft 44, as well as other rotatable shafts in the drive train 34, on a frame 48. The drive shaft 44 also supports third and fourth sprockets 50 and 52 for rotation coaxially with the second sprocket 42.

A chain 54 extends from the third sprocket 50 to a lower sprocket 56. A motor 58 rotates the lower sprocket 56 so as to move the chain 54 in a clockwise direction (as viewed in FIG. 1), and thereby to rotate the third sprocket 50 in a clockwise direction. The shaft 44, and hence the other sprockets 42 and 52 on the shaft 44, are thus rotated in a clockwise direction under the influence of the motor 58.

The pinch roller 30 is supported on an upper drive shaft 60 at a location directly above the roller chain 32. The pinch roller 30 and the roller chain 32 together define a nip 62 for gripping the bars 16. In the preferred embodiment of the present invention, the nip 62 is spaced from the grinder 12 a distance less than the length of a bar 16.

A fifth sprocket 70 is supported on the upper drive shaft 60 at a location axially adjacent to the fourth sprocket 52 on the lower drive shaft 44. A chain 72 extends from the fourth sprocket 52 to the fifth sprocket 70 around a pair of smaller sprockets 74. The smaller sprockets 74 reverse the direction of the chain 72 so that the chain 72 will rotate the fifth sprocket 70 oppositely to the fourth sprocket 52. Accordingly, when the motor 58 rotates the lower drive shaft 44 so as to move the roller chain 32 in the clockwise direction, the pinch roller 30 on the upper drive shaft 60 rotates in the counterclockwise direction. The bars 16 are then moved longitudinally into and through the nip 62 in a direction extending from left to right in FIG. 1. A pair of guide rails 76 are preferably supported on the frame 48 beside the roller chain 32 to guide the bars 16 toward the nip 62.

As noted above, the grinder 12 advances each bar 16 longitudinally between the grinding wheel 20 and the regulating wheel 22 at an advancement speed. In the loading apparatus 14, the drive train 34 rotates the pinch roller 30 at a freewheel r.p.m. with a peripheral surface speed that is greater than the advancement speed in the grinder 12. Therefore, when the roller chain 32 conveys a bar 16 to the nip 62, the pinch roller 30 engages and moves the bar 16 through the nip 62 at a delivery speed that is greater than the advancement speed.

Since the nip 62 is spaced from the grinder 12 a distance less than the length of the bar 16, a leading end portion 80 of the bar 16 moves into engagement with the grinder 12 while a trailing end portion 82 is being gripped and moved through the nip 62. The grinder 12 then offers resistance to further movement of the bar 16 at the delivery speed, and thereby slows movement of the bar 16 from the delivery speed to the advancement speed.

The resistance at the grinder 12 is transmitted through the bar 16 from the grinder 12 to the pinch roller 30 at the nip 62. The individual rollers 84 (FIG. 1) in the roller chain 32 prevent the resistance from affecting the roller chain 32. The resistance is further transmitted from the pinch roller 30 to the fifth sprocket 70 at the opposite end of the upper drive shaft 60, and from the fifth sprocket 70 to the fourth sprocket 52 on the lower drive shaft 44. However, a slip clutch 86 permits the fourth sprocket 52 to slip rotationally relative to the lower drive shaft 44 under the resistance transmitted from the grinder 12. Such slippage in the drive train 34 enables the pinch roller 30 to decelerate from the delivery speed to the advancement speed simultaneously as the bar 16 decelerates from the delivery speed to the advancement speed upon moving into engagement with the grinder 12. The pinch roller 30 then pushes the bar 16 into the grinder 12 with a force that is slightly greater than the resistance offered by the grinder 12, and thus pushes the bar 16 into the grinder 12 at an entry speed that is not greater than the advancement speed. This continues as long as the trailing end portion 82 of the bar is being gripped and moved through the nip 62. When the trailing end portion 82 moves out of the nip 62, the grinder 12 continues to advance the bar 16 at the advancement speed, and the pinch roller 30 accelerates to the freewheel delivery speed for subsequent engagement with another bar 16.

The slip clutch 86 may comprise any suitable structure known in the art, but is preferably adjustable, and most preferably comprises an adjustable magnetic slip clutch known as a PERMA-TORK No. HC5-58. The pinch roller 30 also may comprise any suitable structure known in the art, but is preferably formed of a plastic material such as polyurethane. This helps to ensure that the pinch roller 30 firmly engages the bar 16 or other workpiece without slipping. Further in accordance with this feature of the present invention, the pinch roller 30 preferably has a concave peripheral surface 90 (FIG. 2) with an arcuate contour generally corresponding to the cylindrical surface of the bar 16. This helps to increase surface contact between the pinch roller 30 and the bar 16 at the nip 64.

From the above description of the invention, those skilled in the art will perceive improvements, changes and modifications. For example, the nip 62 in the preferred embodiment of the present invention is spaced from the grinder 12 such that each bar 16 can extend longitudinally into engagement with the grinder 12 while gripped between the pinch roller 30 and the roller chain 32. This spacing enables each bar 16 to transmit resistance from the grinder 12 to the pinch roller 30 in the manner described above. However, the invention is equally applicable to a workpiece load comprising a plurality of separate bars or other workpieces abutting end-to-end between the nip 62 and the grinder 12. Such a workpiece load could transmit resistance through the separate workpieces from the grinder 12 to the pinch roller 30 with the same effect. Such improvements, changes and modifications within the skill of the art are intended to be covered by the appended claims.

Having described the invention, the following is claimed:

1. Apparatus for loading a workpiece into a through-feed mechanism which advances the workpiece through a processing device at an advancement speed, said apparatus comprising:

a roller assembly which grips the workpiece; and a motorized drive train which drives said roller assembly to urge the workpiece toward the through-feed mechanism at a speed greater than the advancement speed;

said drive train including a slip clutch which permits slippage in said drive train under resistance transmitted through the workpiece from the through-feed mechanism to said roller assembly, whereby said roller assembly moves the workpiece toward the through-feed mechanism against said resistance at a speed not greater than the advancement speed.

2. Apparatus as defined in claim 1 wherein said roller assembly includes a pinch roller which grips the workpiece and which transmits said resistance from said workpiece to said drive train.

3. Apparatus as defined in claim 2 wherein said pinch roller is formed of plastic material.

4. Apparatus as defined in claim 2 wherein said pinch roller has a concave peripheral surface.

5. Apparatus as defined in claim 2 wherein said roller assembly further includes a roller chain and grips the workpiece at a nip between said pinch roller and said roller chain.

6. Apparatus comprising:

a centerless grinder having a through-feed mechanism which advances a workpiece at an advancement speed;

a roller assembly which grips the workpiece at a distance spaced from said through-feed mechanism; and a motorized drive train which drives said roller assembly to urge the workpiece toward said through-feed mechanism at a speed greater than said advancement speed;

said drive train including a slip clutch which permits slippage in said drive train under resistance transmitted through the workpiece from said through-feed mechanism to said roller assembly, whereby said roller assembly moves the workpiece toward said through-feed mechanism against said resistance at a speed not greater than said advancement speed.

7. Apparatus as defined in claim 6 wherein the workpiece is elongated, said distance being less than the length of the workpiece so that the workpiece can extend longitudinally into engagement with said through-feed mechanism while gripped by said roller assembly.

8. Apparatus as defined in claim 6 wherein said roller assembly includes a pinch roller which grips said workpiece and which transmits said resistance from said workpiece to said drive train.

9. Apparatus as defined in claim 8 wherein said pinch roller is formed of plastic material.

10. Apparatus as defined in claim 8 wherein said pinch roller has a concave peripheral surface.

11. Apparatus as defined in claim 8 wherein said roller assembly further includes a roller chain and grips the workpiece at a nip between said pinch roller and said roller chain.

* * * * *